US008038008B2

(12) United States Patent
Bitner

(10) Patent No.: US 8,038,008 B2
(45) Date of Patent: Oct. 18, 2011

(54) MEDICAMENT DISPENSER AND ASSOCIATED METHODS

(75) Inventor: John Bitner, Sugar Grove, IL (US)

(73) Assignee: Watson Laboratories, Inc., Salt Lake City, UT (US)

( * ) Notice: Subject to any disclaimer, the term of this patent is extended or adjusted under 35 U.S.C. 154(b) by 716 days.

(21) Appl. No.: 11/316,673

(22) Filed: Dec. 21, 2005

(65) Prior Publication Data

US 2007/0138049 A1 Jun. 21, 2007

(51) Int. Cl.
*B65D 43/16* (2006.01)

(52) U.S. Cl. ..... 206/536; 206/1.5; 206/528

(58) Field of Classification Search ..... 206/528, 206/229, 459.5, 531, 534, 536, 539, 530, 206/1.5, 37; 150/147, 138, 139; 283/36, 283/37

See application file for complete search history.

(56) References Cited

U.S. PATENT DOCUMENTS

| | | | | | |
|---|---|---|---|---|---|
| 405,003 | A | * | 6/1889 | Blackledge | 312/123 |
| 1,455,432 | A | * | 5/1923 | Dodson | 132/295 |
| 2,681,677 | A | * | 6/1954 | Poeltl | 150/147 |
| 3,124,187 | A | * | 3/1964 | Bosca et al. | 150/139 |
| 3,182,789 | A | | 5/1965 | Sparks | |
| 3,242,959 | A | * | 3/1966 | Glass | 206/37 |
| 3,504,788 | A | | 4/1970 | Gray | |
| 3,958,690 | A | | 5/1976 | Gee, Sr. | |
| 4,384,649 | A | | 5/1983 | Brodsky | |
| 4,511,032 | A | | 4/1985 | Bush | |
| 4,535,890 | A | | 8/1985 | Artusi | |
| 4,741,433 | A | * | 5/1988 | Irvine | 206/1.5 |
| 4,817,819 | A | | 4/1989 | Kelly | |
| 4,915,256 | A | | 4/1990 | Tump | |
| 4,984,825 | A | * | 1/1991 | Fowler | 283/98 |
| 4,998,623 | A | | 3/1991 | Doull | |
| D324,305 | S | | 3/1992 | Prey | |
| 5,109,984 | A | | 5/1992 | Romick | |
| 5,265,728 | A | | 11/1993 | Allendorf et al. | |
| 5,348,158 | A | | 9/1994 | Honan et al. | |
| 5,570,810 | A | | 11/1996 | Lambelet, Jr. et al. | |
| 5,878,887 | A | | 3/1999 | Parker et al. | |
| 5,915,559 | A | | 6/1999 | Hulick et al. | |
| 6,173,838 | B1 | | 1/2001 | Brozell | |
| 6,263,141 | B1 | * | 7/2001 | Smith | 385/135 |
| 6,318,550 | B1 | * | 11/2001 | Giovinazzi | 206/308.1 |
| 6,338,408 | B1 | | 1/2002 | Anderson | |
| 6,540,081 | B2 | | 4/2003 | Balz et al. | |
| 6,675,972 | B2 | | 1/2004 | Patterson | |
| 6,789,677 | B2 | | 9/2004 | Maietta | |

(Continued)

FOREIGN PATENT DOCUMENTS

| | | |
|---|---|---|
| EP | 0232674 | 8/1987 |

*Primary Examiner* — J. Gregory Pickett
*Assistant Examiner* — Andrew Perreault
(74) *Attorney, Agent, or Firm* — Florek & Endres PLLC

(57) ABSTRACT

A medicament dispenser comprises a housing having opposing first and second walls. A connecting assembly is associated with at least one of the first and second walls to facilitate connection of the first and second walls to one another. A blister pack containing the medicament is pivotally connected to the connecting assembly so as to be rotatable about the connecting assembly and about an axis of rotation substantially orthogonal to the first and second walls to facilitate movement of the blister pack from: i) a closed position in which the blister pack is substantially enclosed within the housing; and ii) an open position in which the blister pack is at least partially rotated from the housing.

3 Claims, 4 Drawing Sheets

U.S. PATENT DOCUMENTS

| | | | | |
|---|---|---|---|---|
| D498,787 | S | 11/2004 | Nelms et al. | |
| 6,848,580 | B2 | 2/2005 | Paliotta et al. | |
| D502,596 | S | 3/2005 | Smoot | |
| 7,093,736 | B2 * | 8/2006 | Maietta et al. | 221/3 |
| 2003/0102321 | A1 * | 6/2003 | Maietta | 220/824 |
| 2004/0056474 | A1 * | 3/2004 | Alon et al. | 283/36 |
| 2004/0188313 | A1 | 9/2004 | Tedham | |
| 2005/0051454 | A1 | 3/2005 | Coe et al. | |
| 2005/0082194 | A1 | 4/2005 | Fry et al. | |
| 2005/0087473 | A1 | 4/2005 | Fabricius et al. | |
| 2005/0115862 | A1 | 6/2005 | Maietta | |
| 2006/0006091 | A1 * | 1/2006 | Maietta | 206/539 |

* cited by examiner

MEDICAMENT DISPENSER AND ASSOCIATED METHODS

FIELD OF THE INVENTION

The present invention relates generally to systems and methods for storing and dispensing medicaments. More particularly, the present invention relates to medicament dispensing systems that provide protective storage of, and facilitate simplistic dispensing of, medicament contained in one or more blister packs.

BACKGROUND OF THE INVENTION

A variety of products are packaged, stored and delivered to users or consumers in so-called blister packages (or "blister packs"). Products such as medicines, dietary supplements, chewing gum, etc., are provided in blister packs that generally allow consumers to individually dispense a discrete quantity or unit of the product from the blister pack. In a typical application, each unit of the product contained in the blister pack is held in a separate "blister," isolated from other units and also protected from exposure to adverse environments. To dispense a product, a consumer will generally apply pressure or force to a non-rupturable side of the blister pack, and a unit of product is thereby dispensed outwardly from an opposing side of the pack, the opposing side being ruptured as a result of application of the force. In this manner, a user can dispense one unit of product at a time from the blister pack, without exposing, touching or contaminating other units of product that remain in the blister pack.

One particular application in which blister packs have found widespread use is in the area of medicament storage and packaging. Medicaments ranging from over-the-counter cold remedies to birth control medications have been provided in a variety of blister pack configurations. Blister packs are popular in the field of medicine because they allow controlled dosage of discrete units of a medicament from the blister pack while non-dispensed medicament remaining in the blister pack is maintained in a protected state.

In addition, blister packs have provided a way in which related medicaments, which form part of a common regime but have differing strengths and/or formulations, can be provided to a patient in a simple, comprehendible unit. For example, birth control medication is often prescribed on a 28-day cycle regime, with one group of tablets prescribed for the initial 21 days and another group of similar, but differing tablets, prescribed for the final 7-day increment. As information which distinguishes the groups of tablets one from another can be printed on the blister pack, blister packs are a convenient manner in which such regimes can be accommodated without confusing patients, and while also providing a relatively long-term (e.g., one month or longer) supply of medicament to a patient.

While blister packages provide many benefits, they also include a number of disadvantages. One such problem lies in the fact that blister packages are designed to dispense unit doses with relative ease. Thus, applying force to the non-rupturable side of the blister package should result in the opposing side rupturing relatively easily to dispense the medicament. While this design provides ease of dispensation, the medicament stored in the blister pack can be inadvertently dispensed from the blister pack when the non-rupturable side of the pack contacts other items, undesirably forcing medicament from the blisters of the pack. In addition, the rupturable side of the pack can be compromised by contact with other items, and the medicament thereby exposed within the blister of the pack can become contaminated.

In addition, while "bare" blister packs are relatively easy to transport in a pocket, purse, handbag, briefcase, etc., removal of the blister packs from the original carton or box in which they were provided can result in leaving behind important or necessary information printed on the carton or box. Thus, information such as drug interaction information, accidental ingestion information, dosage instructions, warnings, etc., is often not carried with the blister packs containing the medicament to which the information relates.

Due to these considerations, attempts have been made to develop containers for storing blister packs of medicament that allow users to protectively and conveniently carry the blister packs, with some containers allowing simultaneous storage of information sheets bearing information relating to the medicament. However, containers developed to date have proved over-complicated and bulky, and have dispensing mechanisms that can result in the medicament tablets or capsules becoming crushed, split or otherwise damaged during dispensing of the medication. These problems have increased consumers' unwillingness to be bothered with attempting to utilize such containers, and/or with such an increase in handling and packaging costs that the advantages of using blister packs become negated.

SUMMARY OF THE INVENTION

It has been recognized that it would be advantageous to develop a medicament dispensing system for transporting and allowing dispensing of medicament held within a blister package that both protects the blister pack and allows ease of use in dispensing medicament from the blister pack. In addition, it has been recognized that it would be advantageous to develop a medicament dispensing system that allows storage and transport of information-bearing sheets or cards with the blister pack.

Accordingly, the present invention provides a medicament dispenser that includes a housing having opposing first and second walls. A connecting assembly can be associated with at least one of the first and second walls to facilitate connection of the first and second walls to one another. A blister pack containing the medicament can be pivotally connected to the connecting assembly so as to be rotatable about the connecting assembly and about an axis of rotation substantially orthogonal to the first and second walls to facilitate movement of the blister pack from: i) a closed position in which the blister pack is substantially enclosed within the housing; and ii) an open position in which the blister pack is at least partially rotated from the housing.

In accordance with another aspect of the invention, a medicament dispenser is provided, including a housing having opposing first and second walls formed from a continuous piece of material folded intermediate the first and second walls. A connecting assembly can be associated with at least one of the first and second walls to facilitate connection of the first and second walls to one another. A blister pack containing the medicament can be pivotally connected to the housing so as to be rotatable about an axis of rotation substantially orthogonal to the first and second walls to facilitate movement of the blister pack from: i) a closed position in which the blister pack is substantially enclosed within the housing; and ii) an open position in which the blister pack is at least partially rotated from the housing.

In accordance with another aspect of the invention, a medicament dispenser is provided, including a housing having opposing first and second walls. A connecting assembly can be associated with at least one of the first and second walls to facilitate connection of the first and second walls to one another. A blister pack containing the medicament can be pivotally connected to the housing so as to be rotatable about an axis of rotation substantially orthogonal to the first and second walls to facilitate movement of the blister pack from: i) a closed position in which the blister pack is substantially enclosed within the housing; and ii) an open position in which the blister pack is at least partially rotated from the housing. The housing and the blister pack can have substantially matching shapes and substantially matching longitudinal and latitudinal dimensions such that rotation of the blister pack results in a radially-most removed corner of the blister pack rotating beyond an adjacent edge of the housing while the blister pack is rotated from the closed position to the open position.

In accordance with another aspect of the invention, a system for use as a pharmacotherapy aid is provided, including a housing having opposing first and second walls, a blister pack containing the medicament, and an indicia-bearing substrate displaying information relating to a pharmacotherapy regime of which the medicament is a component. The indicia-bearing substrate and the blister pack can be pivotally connected between the first and second walls so as to be rotatable about an axis of rotation substantially orthogonal to the first and second walls to facilitate movement of either of the blister pack and the indicia-bearing substrate from: i) a closed position enclosed between the first and second walls; and ii) an open position at least partially rotated from the first and second walls.

In accordance with another aspect of the invention, a method for associating a blister pack containing a medicament with a housing is provided, including the steps of: orienting the blister pack between opposing first and second walls of the housing; and connecting the first and second walls to one another by securing a connecting assembly associated with at least one of the first and second walls through a portion of the blister pack to thereby pivotally connect the blister pack to the housing.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "blister pack" includes one or more of such blister packs.

Definitions

In describing and claiming the present invention, the following terminology will be used in accordance with the definitions set forth below.

As used herein, the term "blister pack" is to be understood to refer to a package of medicament (or similar product), in which discrete quantities or units of the medicament are stored in a "blister" and dispensed by applying force to the blister to expel or dispense the medicament from the blister pack. It is contemplated that the present invention can be utilized with commonly available blister packaging technology, and can be adapted for use with known blister pack configurations in addition to use with blister packs specifically designed to be incorporated into the present housing configuration.

As used herein, the term "medicament" is to be understood to refer to a variety of medications, drug, pharmaceutics, dietary supplements, etc. As applied to the present invention, medicaments can be available to users or patients as over-the-counter therapy or by prescription only, and can be in the form of tablets, capsules, powders, liquids, creams, granules, etc., as would be readily understood by those having ordinary skill in such fields of endeavor.

As used herein, the term "information relating to a pharmacotherapy regime" is to be understood to refer to variety of types of information relating to a therapy regime indicated and/or prescribed for use by a patient. "Information relating to a pharmacotherapy regime" can include, without limitation, physical, chemical or formulation properties of a medicament, medicament dosage information, drug interaction information, patient-specific information such as age, gender, weight, prescribed or recommended dosages, etc., regime information, administration instructions, warnings, etc.

Figure 4:
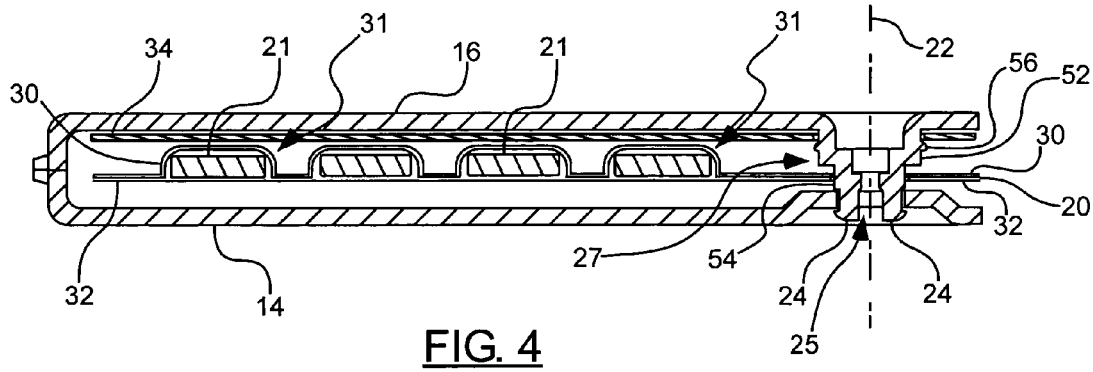
FIG. 4 is a sectional view of medicament dispenser in accordance with an embodiment of the present invention, taken along a latitudinal section intersecting the connecting assembly of the medicament dispenser.

As used herein, the term "orthogonal to one or more walls" of the housing of the medicament dispenser is to be understood to refer to a direction substantially 90° from a plane defined by the broad, relatively flat major surface of the one or more walls. For example, as shown in FIG. 4, axis of rotation 22 forms an angle of approximately 90° to the plane of first wall 14 shown in a horizontal orientation.

As used herein, the term "radially-most removed" is to be understood to refer to a spatial relationship wherein the structure referred to is located the greatest distance, measured along a radius of rotation, from a center of rotation of a body. For example, the term "radially-most removed corner" refers to the corner of a blister pack that is the greatest distance from a center of rotation of the blister pack, measured along a radius of rotation of the blister pack.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 5 inches" should be interpreted to include not only the explicitly recited values of about 1 inch to about 5 inches, but also include individual values and sub-ranges within the indicated range. This same principle applies to ranges reciting only one numerical value and should apply regardless of the breadth of the range or the characteristics being described.

Invention

Figure 1:
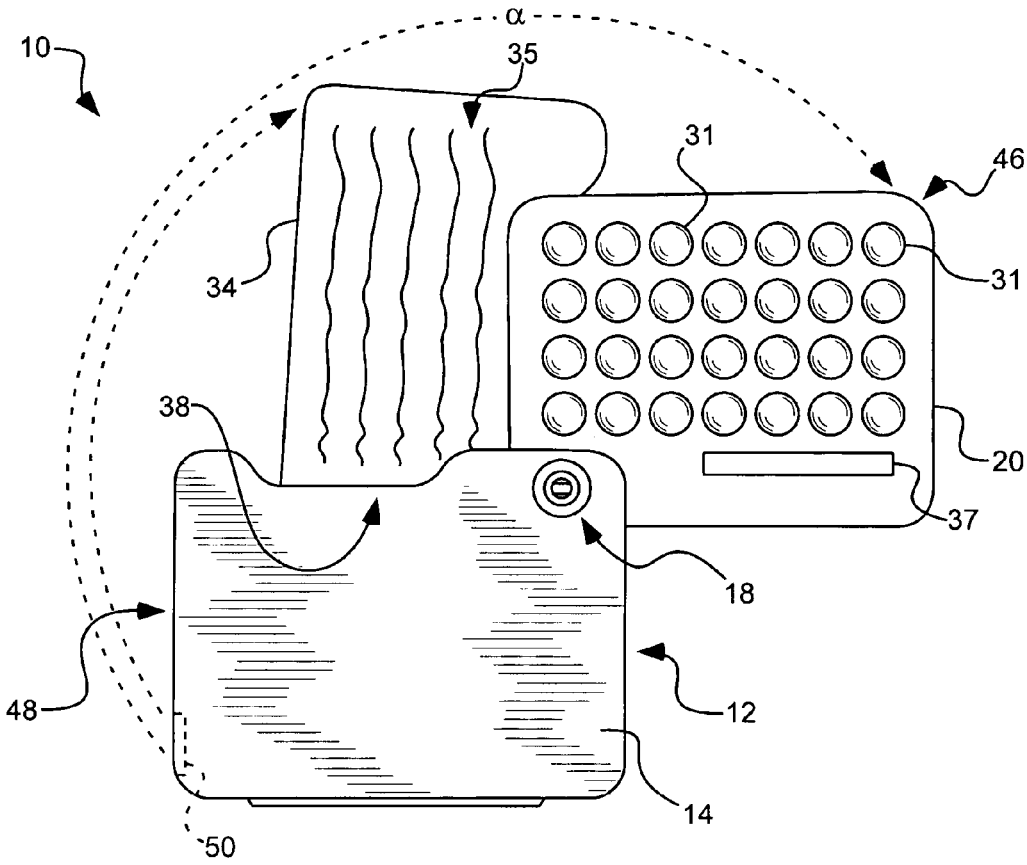
FIG. 1 is a front view of a medicament dispenser in accordance with an embodiment of the present invention, shown with a blister pack and an indicia-bearing substrate rotated into an opened configuration.
Figure 2A:
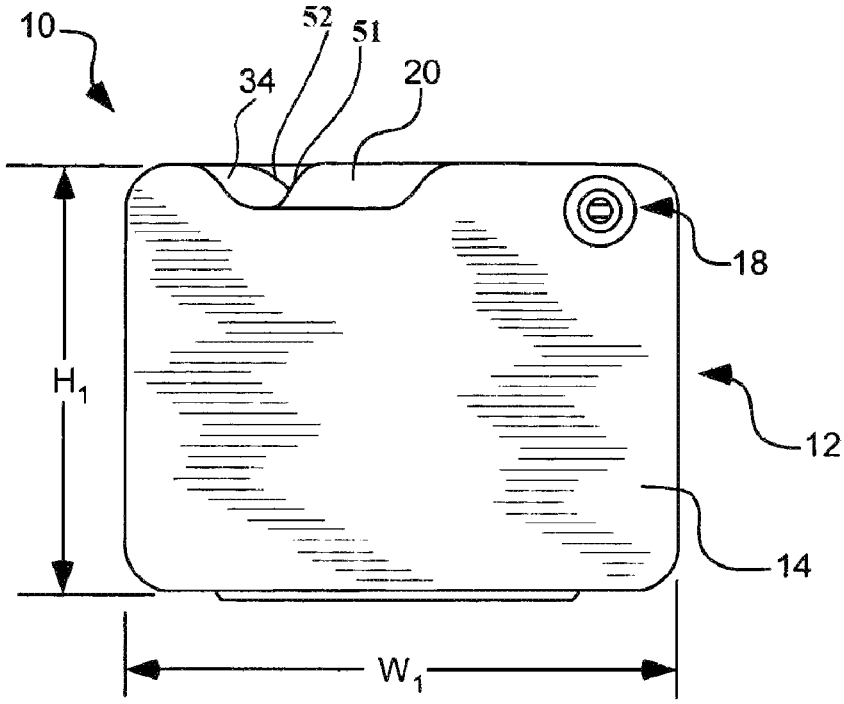
FIG. 2A is a front view of the medicament dispenser of FIG. 1, with the blister pack and indicia-bearing substrate rotated into a closed position.
Figure 2B:
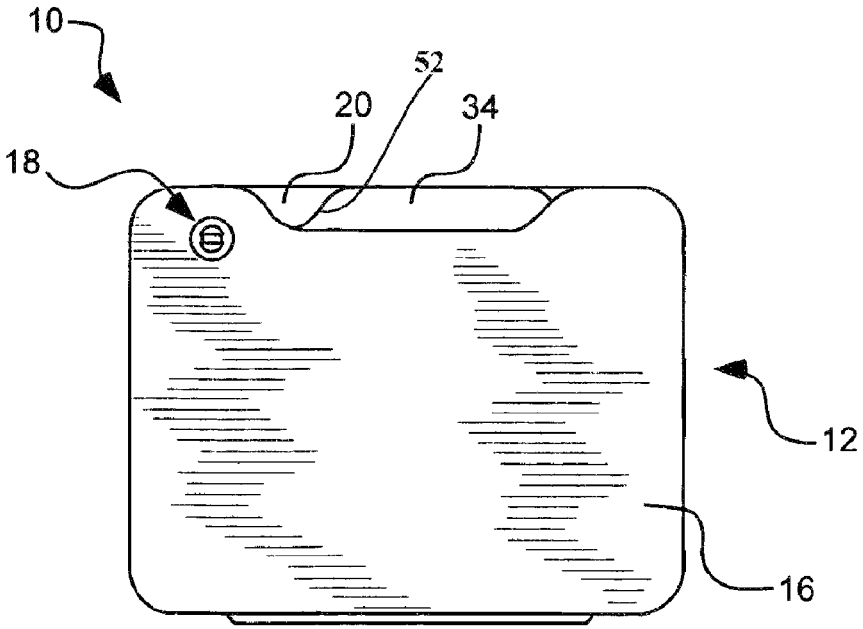
FIG. 2B is a rear view of the medicament dispenser of FIG. 2A.

As illustrated generally in FIGS. 1, 2A and 2B, in one aspect of the present invention a medicament dispenser 10 is provided for storing and facilitating dispensing of a medicament. The dispenser can include a housing 12 that can have opposing first 14 and second 16 walls. A connecting assembly 18 can be associated with at least one of the first and second walls to facilitate connection of the first and second walls to one another. A blister pack 20 can contain the medicament (shown by example at 21 in FIG. 4) and can be pivotally connected to the connecting assembly so as to be rotatable about the connecting assembly and about an axis of rotation (22 in FIG. 4) that is substantially orthogonal to the first and second walls.

Pivotal connection of the blister pack 20 within the housing 12, and/or about the connecting assembly 18, facilitates movement of the blister pack between: i) a closed position (such as that illustrated in FIGS. 2A and 2B) in which the blister pack is substantially enclosed within the housing; and ii) an open position (such as that illustrated in FIG. 1) in which the blister pack is at least partially rotated from the housing. In the closed position, the blister pack is protected by the first 14 and second 16 walls of the housing 12 such that inadvertent contact with the blister pack does not result in inadvertent contamination or dispensing of a unit of medicament 21 from the blister pack. Thus, a patient or user can rotate the blister pack within the housing (i.e., "close" the blister pack) and place the dispenser in a pocket, purse, wallet, briefcase, etc., without risk that other objects in the pocket, purse, etc., will damage the blister pack, and/or risk inadvertent dispensation of medicament from the blister pack, and/or contaminate medicament stored within a blister of the blister pack.

The blister pack 20 can be formed in a variety of manners known to those having ordinary skill in the art and can be formed from a variety of suitable materials. In general, as shown in sectional view in FIG. 4, the blister pack can include a shell material 30 that is formed to include a series of indentations or pockets (e.g., individual "blisters") 31 that are each configured to receive one or more units of medicament 21. The shell material can be, but is not necessarily, formed of a plastic material such as a polyvinyl chloride laminate. A generally thin foil or other rupturable material 32 can be attached or adhered to the shell material around and across the depressions or indentations. Upon application of force to the shell material adjacent one of the units of medicament, the thin foil is ruptured and the unit of medicament is thereby dispensed from its blister.

As will be appreciated, when the blister pack 20 is held within the housing 12, (that is, between the first 14 and second 16 walls), the walls restrict force from being applied to a localized area of the shell material 30 and the medicament is thereby restricted from rupturing the foil material 32. In this manner, the blister pack can be safely stored within the housing until a patient or user desires to dispense one of the units of medicament.

When it is desired to dispense one of the units of medicament 21, a user or patient need only rotate the blister pack 20 to an open position (as shown in FIG. 1) so that at least one of the indentations or pockets 31 is rotated from between the first 14 and second walls 16. Once the blister pack 20 is in the open position, the medicament can be dispensed from the blister pack in the usual manner. As shown in FIG. 1, to ensure that a suitable number of units of medicament can be provided on the blister pack, and also to enable a user or patient to access each of the units of medicament, the present invention provides a great deal of freedom of rotational movement to the blister pack.

In one aspect of the invention, the blister pack 20 can be rotated from a closed position to an open position through an angle or arc of adjustment "$\alpha$" of at least 180°. In other aspects of the invention, the angle or arc of adjustment can vary, depending upon the number of units of medicament stored in the blister pack and in the configuration, or pattern, in which the units are arrayed on the blister pack.

As will be appreciated from FIG. 1, once the blister pack is rotated into an open position, e.g., once one or more of the individual blisters is rotated beyond the first 14 and second 16 walls, the medicament can be dispensed from an individual blister without requiring that the individual blister be oriented in any particular location. This feature of the invention is advantageous over many conventional dispensers that require that a unit of medicament be aligned over an opening in a substrate prior to dispensing the unit of medicament from the blister. As patients or users can often misalign the unit of medicament prior to attempting to dispense the medicament (or it can be misaligned during the packaging operation), conventional medicament dispensers often crush, split or otherwise damage tablets or capsules as they are dispensed. In contrast, the present invention provides a very "compliant" dispenser by facilitating dispensation of medicament in a manner that does not risk damage to the tablet or capsule.

While not so required, in the aspect of the invention illustrated in the figures, the blister pack 20 is rotatably connected or coupled to the housing 12 by way of the connecting assembly 18. As shown in FIGS. 3B and 4, the connecting assembly 18 can include a pair of flanged fingers 24 that are formed as part of, or are coupled to, the second wall 16. The fingers can mate with and engage aperture 26 formed in the first wall 14 to connect the first and second walls one to another. In one embodiment of the invention, the fingers 24 are inserted through aperture 28 (FIG. 5) formed in blister pack 20 prior to being inserted into aperture 26 of the second wall. In this manner, the blister pack is rotatably coupled about the connecting assembly at the same time that the walls of the housing are connected to one another.

In this embodiment, at least a portion of the blister pack 20 circumscribes the connecting assembly 18 to ensure that the blister pack is not easily removed from, or cannot inadvertently fall from, the housing 12. Thus, while the present invention provides a system in which medicament within the dispenser 10 can be relatively easily and quickly accessed, the blister pack is securely and protectively held within the housing in both the closed and the open configuration.

As shown in FIG. 4, the connecting assembly 18 can include a rod or post 27 of which the fingers 24 can form a portion. The rod can include at least two different sections 52, 54 that each can have a diameter different from the other. In the embodiment shown, blister pack 20 can be disposed about section 54 and an indicia-bearing substrate 34 (discussed in more detail below) can be disposed about section 52, with each of the blister pack and the indicia-bearing substrate having different diameters that correspond with the respective section of the post that they circumscribe. Section 52 of the post or rod can include a ridge 56 that can serve to retain the indicia-bearing substrate on the section 52 of the post; e.g., the ridge can serve to limit the indicia-bearing substrate from traveling downward onto section 54 of the post. As will be appreciated, as the diameter of section 52 is larger than the diameter of section 54, the blister pack (having an aperture with a diameter only slightly larger than the diameter of the section 54 of the post) is prevented from traveling upward on the post into section 52. In this manner, the blister pack and the indicia-bearing substrate are held on the post in a spaced-apart relationship. The spaced-apart relationship can aid in limiting the indicia-bearing substrate and the blister pack from fictionally engaging each other (that is, from "sticking together") within the housing to allow a patient or user to more easily rotate one of the items into an open position without also rotating the other item into an open position.

While the connecting assembly 18 shown in FIGS. 3B and 4 includes fingers 24 that mate with aperture 26, it is to be understood that the present invention can include a variety of suitable connecting assembly configurations. The connecting assembly can incorporate a variety of connecting structure known to those of ordinary skill in the art, including frictional engaging structure, adhesive configurations, threaded engagement structure, etc. Also, the connecting assembly 18, including rod or post 27, can be associated with one or both of the first 14 or second 16 walls in a variety of manners. In the embodiment illustrated in FIG. 4, the connecting assembly is formed as an integral part of the housing 12 (e.g., the first and second walls and the connecting assembly are formed as one continuous piece). In other embodiments, the connecting assembly can be attached to one or both of the first or second walls, or can be otherwise operably disposed between one or both of the first and second walls.

Figure 5:
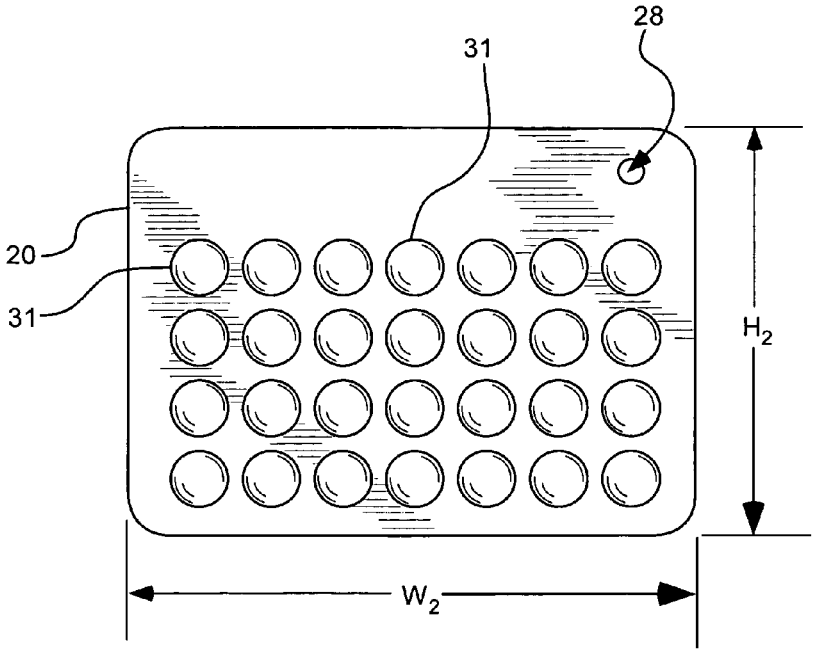
FIG. 5 is a front view of a blister pack in accordance with an embodiment of the invention.

In addition, while blister pack 20 is shown in FIG. 5 as having aperture 28 formed therein, it is contemplated that the blister pack can be provided with no aperture formed therein, and the connecting structure can pierce the blister pack material during connection of the first 14 and second 16 walls to thereby rotatably connect the blister pack to the housing and/or the connecting assembly.

As illustrated in FIG. 4, the fingers 24 can include a space 25 therebetween which allows the fingers to be flexed toward one another to enable the fingers to be disposed through aperture 26. After the fingers are inserted through the aperture to a sufficient degree, the fingers are allowed to return to their normal configuration, where they engage the aperture and secure the first and second walls to one another. By forming the fingers (and/or the housing) from a material such as polypropylene, the fingers can be provided with "shape memory" to allow them to return to an original shape and position upon being released after being inserted through the aperture.

The fingers thus provide a connecting assembly that can be selectively secured and unsecured by a user to allow the user to open the housing at some point after the connecting assembly has been secured through the blister pack. In this manner, the medicament dispenser of the present invention can be refilled with a fresh blister pack of medicament upon exhaustion of the supply of medicament within the original blister pack.

The housing is not, however, limited to a reusable unit, but can incorporate a connecting assembly that is substantially permanent such that connection of the first and second walls to one another cannot be easily reversed, and the unit can simply be discarded once the supply of medicament in the original blister pack is exhausted. This feature of the invention can be advantageous in applications where a pharmacy or drug company wishes to ensure that consumers or patients cannot easily separate an indicia-bearing substrate 34 (discussed in more detail below) and/or the blister pack 20 from the housing 12. In this manner, the pharmacy or drug company can ensure, for example, that critical information relating to the medicament is always stored and carried with the medicament.

It is contemplated that the blister pack 20 can be installed between the first 14 and second 16 walls of the housing 12 at various times during the life of the product. For example, the blister pack can be installed within the housing at the point of manufacture of the medicament and the dispenser can be shipped to a retailer or pharmacy in a "filled" capacity. In other embodiments, one or more empty housings can be provided to pharmacy personnel and the blister packs can be installed within the housing at the time a prescription is filled for a patient or user. Also, it is contemplated that more than one blister pack of medicament can be provided at one time in a given housing, such that a plurality of blister packs can be rotatably coupled or attached within the housing to provide a larger supply of medicament within a given housing. Each of the plurality of blister packs can contain the same medicament, or one or more of the plurality of blister packs can contain differing medicaments.

Returning to FIG. 1, in one aspect of the invention, the medicament dispenser 10 can include an indicia-bearing substrate 34 that can be pivotally connected to the housing 12 in the same manner in which the blister pack 20 is connected to the housing. The indicia-bearing substrate can thereby also be rotatable about the connecting assembly 18 and about axis of rotation 22 (FIG. 4) substantially orthogonal to the first 14 and second 16 walls to facilitate movement of the indicia-bearing substrate from a closed position (as shown in FIGS. 2A and 2B) to an open position (as shown in FIG. 1). In this manner, the housing can contain not only a blister pack having medicament disposed therein, but also can contain an information card or similar device on which information relating to the medicament can be displayed.

While not so required, the indicia-bearing substrate can display information 35 relating to a pharmacotherapy regime of which the medicament is a component, providing a user or patient with access to important information that is generally not printed on or attached to conventional blister pack products. The indicia-bearing substrate can also include areas in which the user or patient can record information, for example, how much medicament, and at what time, the user has ingested or otherwise consumed. The indicia-bearing substrate can also provide a convenient surface for attachment of a pharmacy label, which can include information relating to a pharmacotherapy regime such as prescription number, refill information, dosage instructions, pharmacy telephone number, etc. Also, an area 37 can be utilized to print or otherwise apply a barcode or similar identification information to the blister pack 20.

The dispenser can include an access notch 38 formed in at least one of the first 14 and second 16 walls of the housing 12 to allow a user to contact the blister pack 20 when it is in the closed position. In this manner, a user can quickly and easily grasp the blister pack with his or her fingers to rotate the blister pack into the open position. While the configuration illustrated in the figures includes an access opening that allows a user to grasp and pull the blister pack into the open position, it is contemplated that the access notch can be situated such that a user pushes the blister pack from the housing toward or into the open position. The blister pack 20 and/or the indicia-bearing substrate 34 can also include an access notch 51 and 52 respectively, to allow the user to contact either of the indicia-bearing substrate or the blister pack while one or both of the indicia-bearing substrate and the blister pack is in the closed configuration.

Thus, the present invention provides a user or patient with quick access to either or both of the blister pack 20 and the indicia-bearing substrate 34, even when either or both are in the closed position. In this manner, the medicament, and/or the information included on the indicia-bearing substrate, can be easily accessed by a user or patient by grasping and rotating the blister pack or indicia-bearing substrate and rotating it into the open position. This feature of the dispenser can further enhance the compliance of the dispenser, aiding patients in taking the correct dosage of medicament at the correct intervals and for the correct period of time in which the medicament is prescribed.

In addition to the access notch 38 formed in the housing 12, in one aspect of the invention, the blister pack or indicia-bearing substrate 34 can include a protruding tab (not shown) that protrudes beyond the walls 14, 16 of the housing to enable a user to grasp and manipulate the blister pack or indicia-bearing substrate into the open configuration.

The housing 12 can be formed in a variety of configurations and can be formed from a variety of materials. In one aspect of the invention, the housing is formed from polypropylene. The housing can also be formed in a variety of colors, each of which can correspond to a particular information type, e.g., a type of medicament stored in the container, a dosage strength of the medicament, etc. In this manner, the housing (and/or the blister pack itself, or components of the blister pack) can be color-coded to allow medical personnel or patients to easily identify particular types of dispensers. The first 14 and second 16 walls can be formed from a continuous piece of material which can be, for example, produced by injection molding as an integral unit. In one embodiment, a hinge 40 (FIGS. 3A and 3B), which can be a living hinge, can be formed intermediate the first and second walls to hingedly couple the first and second walls to one another. This aspect of the invention can be advantageous in those embodiments in which the blister pack is designed to be replaceable by the user or patient, and the first and second walls may be subject to multiple opening and closing cycles during the life of the housing.

As shown in FIG. 3B, the housing 12 can be openable into a substantially planar configuration with multiple housings being nestable one within another while in the planar configuration. This aspect of the invention can allow multiple housings to be packaged and shipped in a compact manner. For example, a pharmacy might purchase a quantity of housings that can be easily stored by the pharmacy in the nestable configuration; then each housing can be fitted with one or more blister packs as prescriptions are filled for patients. This aspect of the invention can also facilitate more efficient, high-speed automated production.

Figure 3A:
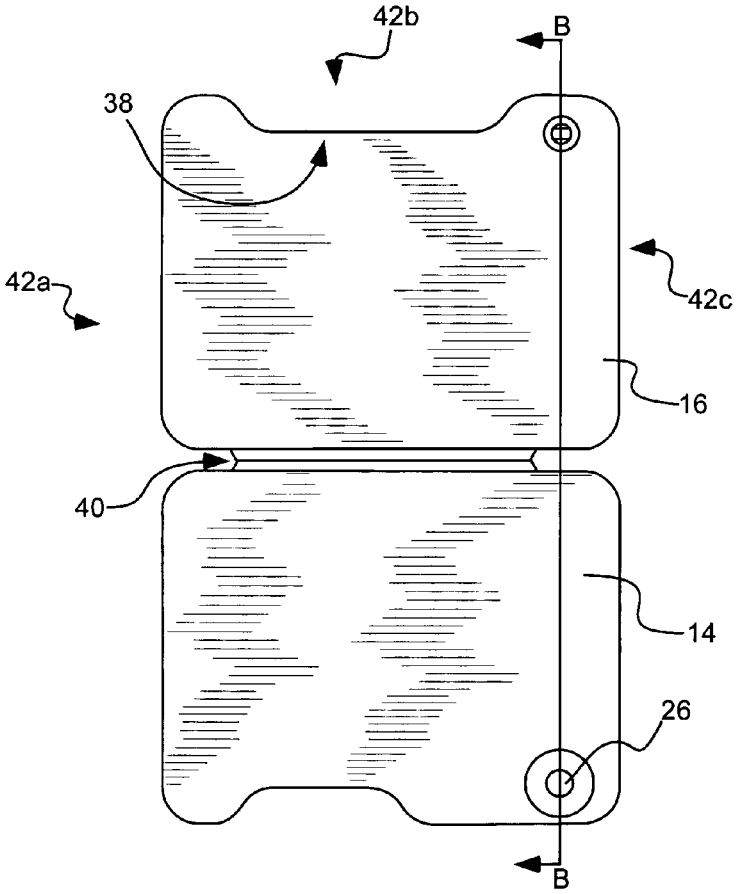
FIG. 3A is plan view of a housing of a medicament dispenser in accordance with an embodiment of the present invention, shown opened in a substantially planar configuration.
Figure 3B:
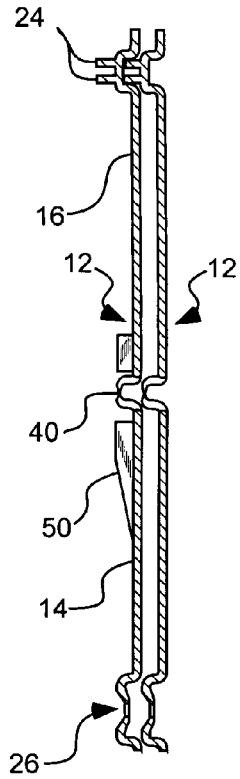
FIG. 3B is a sectional view of the housing of FIG. 3A, taken along section B-B of FIG. 3A and shown in a nested configuration with a second, substantially identical housing.

It will be appreciated from FIGS. 3A and 3B that at least three side edges (e.g., side edges 42*a*, 42*b* and 42*c*) of the housing 12 can be at least partially open to movement of the blister pack 20 past the side edges after the first 14 and second 16 walls are connected to one another. In this manner, the blister pack can rotate through a wide range of angular displacements. In addition, this aspect of the invention can allow formation of the housing and the blister pack in substantially the same shape with substantially the same longitudinal and latitudinal dimensions. Thus, as shown in FIGS. 2A and 5, in one embodiment, the housing 12 can include a longitudinal dimension $W_1$ that is substantially the same as a longitudinal dimension of the blister pack $W_2$ (despite the fact that the dimension may not be drawn to the same scale in the two drawings). Similarly, the housing can include a latitudinal dimension $H_1$ that is substantially the same as a latitudinal dimension $H_2$ of the blister pack.

The housing 12 and the blister pack 20 can thus be shaped such that rotation of the blister pack results in a radially-most removed corner 46 (FIG. 1) of the blister pack rotating beyond an adjacent edge 48 of the housing while the blister pack is rotated from the closed position to the open position. As discussed above, the blister pack can be rotatable about the connecting assembly in an arc or angle $\alpha$, of at least 180 degrees. By configuring the size, shape and relative orientation of the housing and blister pack in such a manner, the present invention provides a medicament dispensing device that need not be sized considerably larger than the size of the blister pack, and need not incorporate structure to compensate for the rotation of the blister pack within the housing. The medicament dispenser can thus be provided in a compact, easy to transport configuration that is only minimally more difficult to carry and store than would be a conventional blister pack carried without a housing.

As shown in FIGS. 1 and 3B, the dispenser 10 can include interference structure 50 that can be configured to at least partially interfere with opening and/or closing of the blister pack 20 (and/or the indicia-bearing substrate 34). In the embodiment shown, the interference structure includes a tapered ledge 50 (best appreciated from viewing FIG. 3B) over which the radially-most removed corner of the blister pack or indicia-bearing substrate must pass when opening or closing. The tapered ledge can thus aid in maintaining the indicia-bearing substrate and the blister pack in a closed configuration, but presents only a minor obstruction to overcome by a user or patient when opening the blister pack or indicia-bearing substrate. By ensuring that the blister pack is not inadvertently moved into the open position, the interference structure increases the compliance of the present dispenser by reducing the likelihood of inadvertent rupture of or damage to the blister pack.

In addition to the structural features discussed above, the present invention can also provide a method for associating a blister pack containing a medicament with a housing, comprising the steps of: orienting the blister pack between opposing first and second walls of the housing; and connecting the first and second walls to one another by securing a connecting assembly associated with at least one of the first and second walls through a portion of the blister pack to thereby pivotally connect the blister pack to the housing. The method can include the further step of securing the connection assembly associated with at least one of the first and second walls through a portion of an indicia-bearing substrate to thereby pivotally connect the indicia-bearing substrate to the housing. The method can include the further step of securing the connecting assembly associated with at least one of the first and second walls through a portion of a plurality of blister packs to thereby pivotally connect the plurality of blister packs to the housing.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A medicament dispenser, consisting of:

a housing having opposing first and second walls;

a hinge formed intermediate the first and second walls to hingedly couple the first and second walls to one another wherein at least three side edges of the housing are open to movement of a blister pack past the side edges;

a connecting assembly comprising a pair of flanged fingers associated with the first or second walls and an aperture associated with the wall opposite the wall associated with the flanged fingers wherein when the fingers are inserted through the aperture, the first and second walls are coupled together;

one or more blister packs containing a medicament, pivotally connected directly to the connecting assembly so as to be rotatable about the connecting assembly in an arc of at least 180 degrees and about an axis of rotation orthogonal to the first and second walls to facilitate movement of the one or more blister packs from: i) a closed position in which the one or more blister packs are located within the housing; and ii) an open position in which the one or more blister packs are rotated from the housing, wherein an access notch is formed on an edge of at least one of the one or more blister packs allowing access to the one or more blister packs in the closed position; and an access notch formed on the edge of at least one of the first and second walls of the housing to allow a user to grasp the one or more blister packs with his or her fingers to rotate the one or more blister packs from the closed position to the open position;

said medicament dispenser further comprising an interference structure comprising a tapered ledge located on the first or second wall and diagonal from said connecting assembly, said interference structure configured to partially interfere with a radially-most removed corner of said blister pack.

2. A medicament dispenser consisting of:

a housing having opposing first and second walls;

a hinge formed intermediate the first and second walls to hingedly couple the first and second walls to one another wherein at least three side edges of the housing are open to movement of a blister pack past the side edges;

a connecting assembly comprising a pair of flanged fingers associated with the first or second walls and an aperture associated with the wall opposite the wall associated with the flanged fingers wherein when the fingers are inserted through the aperture, the first and second walls are coupled together;

one or more blister packs containing a medicament, pivotally connected directly to the connecting assembly so as to be rotatable about the connecting assembly in an arc of at least 180 degrees and about an axis of rotation orthogonal to the first and second walls to facilitate movement of the one or more blister packs from: i) a closed position in which the one or more blister packs are located within the housing; and ii) an open position in which the one or more blister packs are rotated from the housing;

one or more indicia-bearing substrates, pivotally connected to the connecting assembly so as to be rotatable about the connecting assembly in an arc of at least 180 degrees and about an axis of rotation orthogonal to the first and second walls to facilitate movement of the one or more indicia-bearing substrates from: i) a closed position in which the one or more indicia-bearing substrates are located within the housing; and ii) an open position in which the one or more indicia-bearing substrates are rotated from the housing; and an access notch formed on the edge of at least one of the first and second walls of the housing to allow a user to grasp the one or more blister packs and/or the one or more indicia-bearing substrates with his or her fingers to rotate the one or more blister packs and/or the one or more indicia bearing substrates from the closed position to the open position;

wherein an access notch is formed on at least one of the one or more blister packs to allow the user to contact the one or more indicia-bearing substrates in the closed position, and/or wherein an access notch is formed on at least one of the one or more indicia-bearing substrates to allow the user to contact the one or more blister packs, when the one or more blister packs and/or the one or more indicia-bearing substrates are in the closed configuration;

said medicament dispenser further comprising an interference structure comprising a tapered ledge located on the first or second wall and diagonal from said connecting assembly, said interference structure configured to partially interfere with a radially-most removed corner of said blister pack and indicia bearing substrate.

3. A medicament dispenser, consisting of:

a housing having opposing first and second walls;

a connecting assembly associated with at least one of the first and second walls to facilitate connection of the first and second walls to one another;

a plurality of blister packs containing a medicament, pivotally connected to the connecting assembly so as to be rotatable about the connecting assembly and about an axis of rotation orthogonal to the first and second walls to facilitate movement of the plurality of blister packs from: i) a closed position in which the plurality of blister packs are located within the housing; and ii) an open position in which the plurality of blister packs are rotated from the housing;

an access notch formed in at least one of the first and second walls of the housing to allow a user to grasp the plurality of blister packs with his or her fingers to rotate the plurality of blister packs from the closed position to the open position; and a plurality of indicia-bearing substrates pivotally connected to the connecting assembly so as to be rotatable about the connecting assembly and about an axis of rotation orthogonal to the first and second walls to facilitate movement of the plurality of indicia-bearing substrates from: i) a closed position in which the plurality of indicia-bearing substrates are located within the housing; and ii) an open position in which the plurality of indicia-bearing substrates are rotated from the housing;

wherein an access notch is formed on at least one of the plurality of blister packs to allow the user to contact at least one of the plurality of indicia-bearing substrates in the closed position, and/or wherein an access notch is formed on at least one of the plurality of indicia-bearing substrates to allow the user to contact at least one of the plurality of blister packs, when the plurality of blister packs and/or the plurality of indicia-bearing substrates are in the closed configuration;

said medicament dispenser further comprising an interference structure comprising a tapered ledge located on the first or second wall and diagonal from said connecting assembly, said interference structure configured to partially interfere with a radially-most removed corner of said blister pack and indicia bearing substrate.

* * * * *